US006450600B1

(12) United States Patent
Chen et al.

(10) Patent No.: US 6,450,600 B1
(45) Date of Patent: Sep. 17, 2002

(54) RETAINING STRUCTURE FOR A TRACK DEVICE FOR PREVENTING INADVERTENT INWARD MOVEMENT

(75) Inventors: Ken-Ching Chen; I-Ming Tseng; Shu-Jiuan Lin, all of Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 09/920,845

(22) Filed: Aug. 3, 2001

(51) Int. Cl.[7] ..... A47B 88/04
(52) U.S. Cl. ..... 312/334.46; 312/333
(58) Field of Search ..... 312/333, 330.1, 312/334.1, 334.7, 334.8, 334.11, 334.44, 334.46, 334.47; 384/18, 21, 22

(56) References Cited

U.S. PATENT DOCUMENTS 4,998,828 A * 3/1991 Hobbs ..... 312/334.46 X
5,181,782 A * 1/1993 Wojcik ..... 312/334.44 X
5,757,109 A * 5/1998 Parvin ..... 312/334.11
5,951,132 A * 9/1999 Cirocco ..... 312/334.46
6,238,031 B1 * 5/2001 Weng ..... 312/333
6,257,683 B1 * 7/2001 Yang ..... 312/333
6,350,001 B1 * 2/2002 Chu ..... 312/334.44
6,390,575 B1 * 5/2002 Chen et al. ..... 312/334.46

* cited by examiner

*Primary Examiner*—James O. Hansen
(74) *Attorney, Agent, or Firm*—Bacon & Thomas, PLLC

(57) ABSTRACT

A retaining structure. The retaining structure includes a retaining member on a first track and a pressing block on a second track slidably received in the first track. The retaining member has two resilient legs and the pressing block has two protrusions. When the second track is mounted in the first track and pulled outward to a predetermined position, the legs of the retaining member press against inner sides of the protrusions of the pressing block to prevent inadvertent inward movement of the second track in the first track. When the second track in the predetermined position is pushed inwards by an appropriate force, the protrusions of the pressing block press to deform the legs of the retaining member to allow the protrusions of the pressing block to move across the retaining member, thus allowing inward movement of the second track in the first track.

11 Claims, 4 Drawing Sheets

RETAINING STRUCTURE FOR A TRACK DEVICE FOR PREVENTING INADVERTENT INWARD MOVEMENT

BACKGROUND OF THE INVENTION

1. Field of the Invention

The present invention relates to a retaining structure for a track device for preventing inadvertent inward movement.

2. Description of the Related Art

FIG. 6 of the drawings illustrates a so-called "three-part" conventional track device for a drawer. The track device includes an outer track 91, a middle track 92, and an inner track 93. A plurality of rolling balls 94 are mounted between the middle track 92 and the inner track 93 to allow easy sliding movement of the inner track 93 in the middle track 92. In order to allow easy assembly, the inner track 93 has a claw 95 with a resilient leg 96 and the middle track 92 has a stop 97. The resilient leg 96 can be pressed to allow a protrusion 951 of the claw 95 to move across a stop piece 971 of the stop 97, thereby allowing assembly or detachment between the inner track 93 and the middle track 92. After the inner track 93 has been engaged in the middle track 92, the protrusion 951 of the claw 95 is engaged with the stop piece 971 of the stop 97 when the inner track 93 is pulled outward to a predetermined position, thereby preventing disengagement of the inner track 93 from the middle track 92. However, no means is provided to prevent inadvertent inward movement of the inner track 93 into the middle track 92 when the inner track 93 is inadvertently impinged by the user's elbow or an alien object. In convenience is thus occurred.

SUMMARY OF THE INVENTION

An object of the present invention is to provide a retaining structure for a track device for preventing inadvertent inward movement. The retaining structure comprises a retaining member on a first track and a pressing block on a second track slidably received in the first track. The retaining member has two resilient legs and the pressing block has two protrusions. The legs of the retaining member press against the protrusions of the pressing block when the second track is pulled outward to a predetermined position, thereby preventing inward movement of the second track in the first track. Thus, improvement in convenience during use is provided.

A retaining structure in accordance with the present invention comprises a retaining member on a first track and a pressing block on a second track slidably received in the first track. The retaining member has two resilient legs and the pressing block has two protrusions. When the second track is mounted in the first track and pulled outward to a predetermined position, the legs of the retaining member press against inner sides of the protrusions of the pressing block to thereby prevent inadvertent inward movement of the second track in the first track. When the second track in the predetermined position is pushed inward by an appropriate force, the protrusions of the pressing block press against and thus deform the legs of the retaining member to thereby allow the protrusions of the pressing block to move across the retaining member, thereby allowing inward movement of the second track in the first track.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
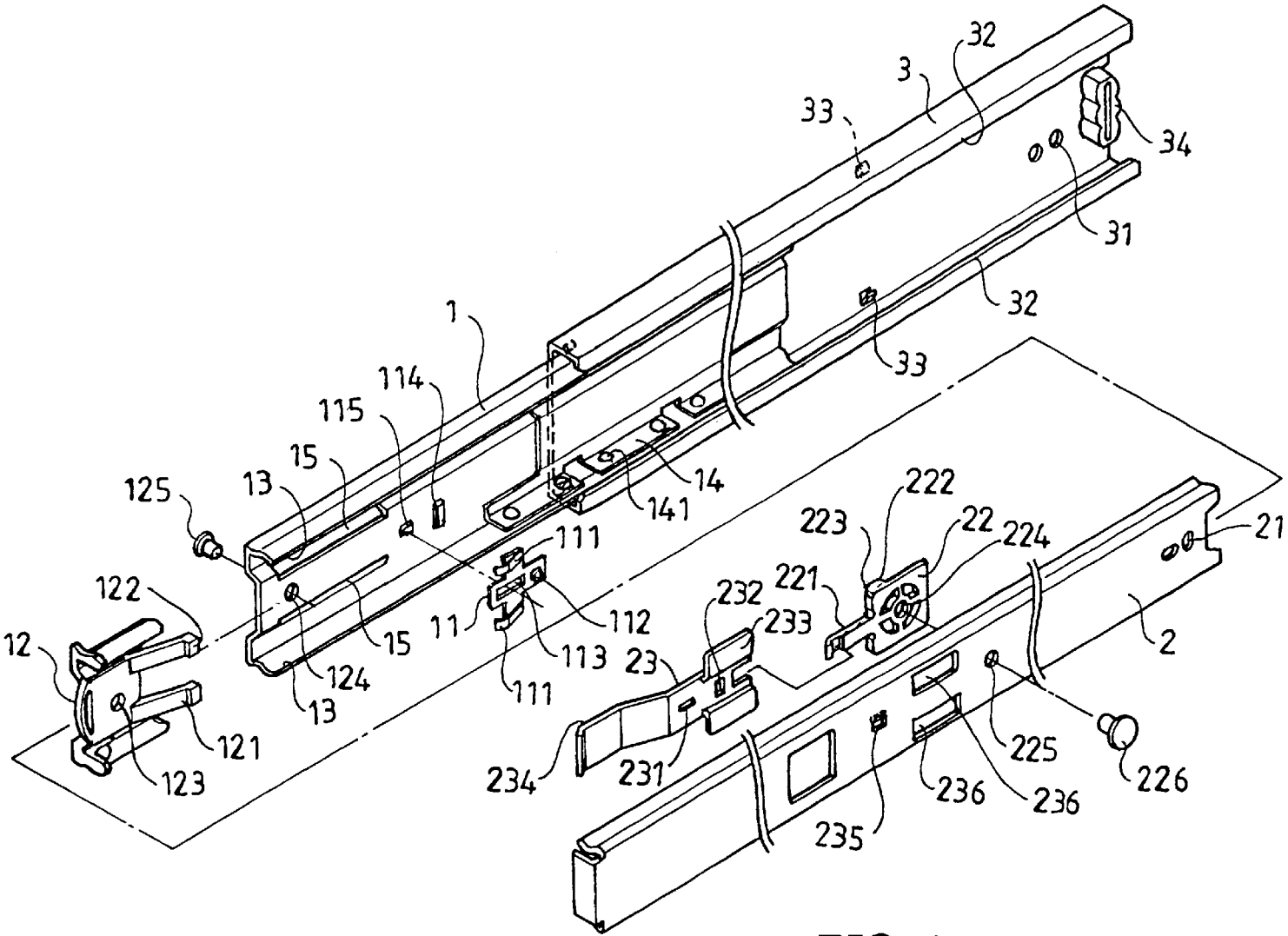
FIG. 1 is an exploded perspective view of a track device in accordance with the present invention.

Referring to FIG. 1, a retaining structure in accordance with the present invention comprises a retaining member 11 on the first track 1 and a pressing block 22 on the second track 2. A track device in accordance with the present invention generally includes a first track 1 and a second track 2. The first track 1 comprises a retaining member 11, a catching member 12, an upper longitudinal lip 13, a lower longitudinal lip 13, a set of slide-aiding members 14, and two slots 15. The retaining member 11 comprises two resilient legs 111, a mounting member 112, and a positioning hole 113. The catching member 12 is mounted to an end of the first track 1 and comprises two legs 121 each having a hook end 122 and a hole 123. The upper and the lower longitudinal lips 13 guide sliding movement of the second track 2 in the first track 1. The slide-aiding members 14 are provided between the first track 1 and the second track 2 and comprises balls 141 for rolling contact between the first track 1 and the second track 2.

The second track 2 comprises a hole 21, a pressing block 22, and a resilient pressing member 23. The hole 21 allows the second track 2 to be fixed to a lateral side (not shown) of a drawer (not shown). The pressing block 22 comprises a pressing leg 221, two protrusions 222, two shoulders 223, and a positioning hole 224. The resilient pressing member 23 is made of a resilient material with proper resiliency. The resilient pressing member 23 comprises a positioning hole 231, a hole 232, two tappet plates 233, and a pressing portion 234.

In this embodiment, the track device further comprises a third track 3 including plural holes 31, an upper longitudinal lip 32, a lower longitudinal lip 32, two stops 33, and an end stop 34. The holes 31 allow the third track 3 to be fixed to an inner lateral wall (not shown) of a furniture piece (not shown) in which the drawer is received. The upper longitudinal lip 32 and the lower longitudinal lip 32 of the third track 3 guide sliding movement of the first rack 1 in the third track 3. The stops 33 prevent the first track 1 from falling out of the third track 3 via an inner end of the third track 3. The end stop 34 prevents the first track 1 and the second track 2 from disengaging from the third track 3 after the first track 1 and the second track 2 is mounted into the third track 3.

Figure 2:
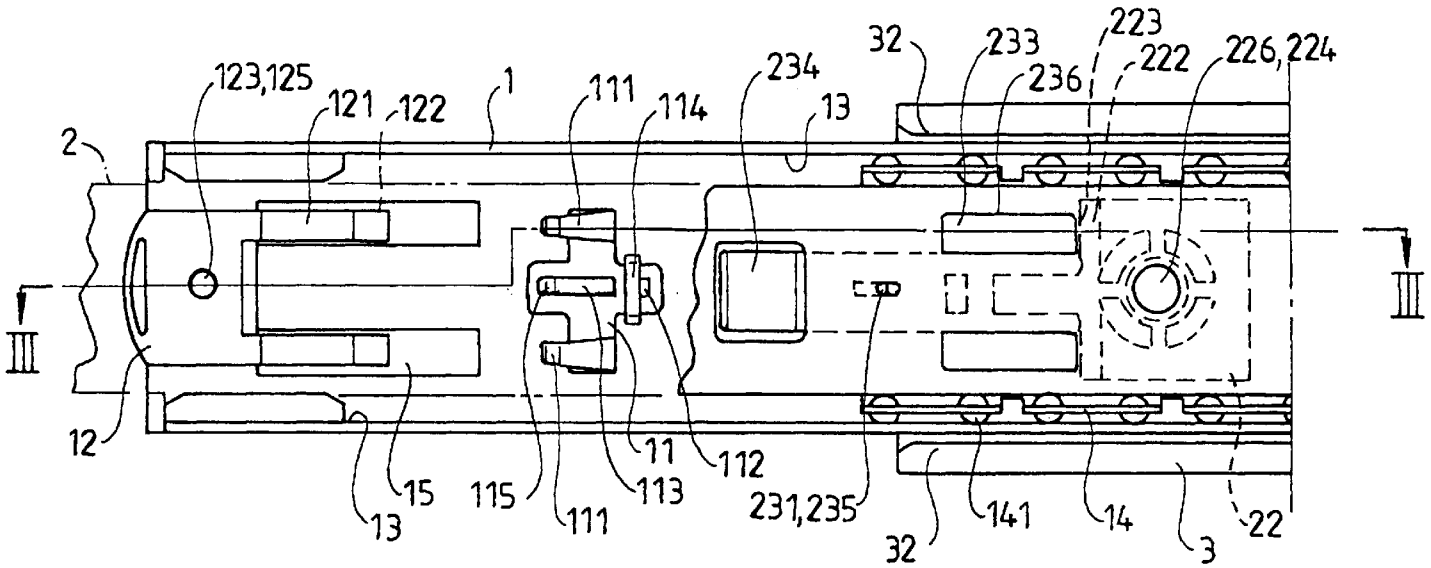
FIG. 2 is a partial sectional perspective view of the track device in accordance with the present invention, wherein a retaining member of a first track has not engaged with a pressing block of a second track yet.
Figure 3:
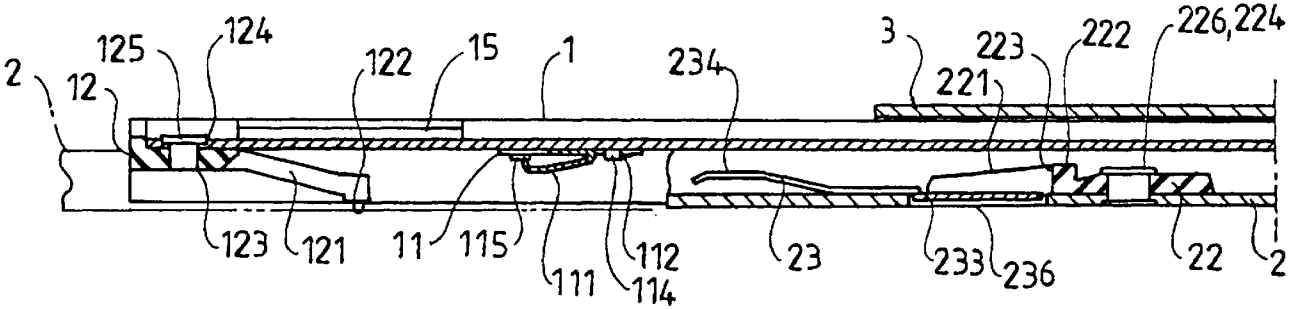
FIG. 3 is a sectional view taken along line 3—3 in FIG. 2.

The retaining member 11 of the first track 1 in FIGS. 2 and 3 has not engaged with the pressing block 22 of the second track 2 yet. The retaining member 11 is preferably made from a resilient metal sheet and the leg 111 of the retaining member 11 has an arcuate distal end. In order to tightly fix the retaining member 11 to the inner side of the first track 1, the mounting member 112 of the retaining member 11 is engaged in an engaging slot 114 of the first track 1, and a positioning block 115 of the first track 1 is engaged in the positioning hole 113 of the retaining member 11. Furthermore, in order to secure the catching member 12 to the first track 1, the hole 123 of the catching member 12 is aligned with a hole 124 of the firs track 1, and a fastener 125 is then extended through the hole 123 of the catching member 12 and the hole 124 of the first track 1, thereby securing the catching member 12 in place.

The pressing leg 221 of the pressing block 22 of the second track 2 presses against the resilient pressing member 23 to thereby secure the resilient pressing member 23 to the second track 2. After aligning the positioning hole 224 of the pressing block 22 with a hole 225 in the second track 2, a fastener 226 is extended through the positioning hole 224 of the pressing block 22 and the hole 225 of the second track 2, thereby securing the pressing block 22 to the second track 2. A positioning block 235 on the second track 2 is securely received in the positioning hole 231 of the resilient pressing member 23 to thereby secure the resilient pressing member 23 to the second track 2 with the tappet plates 233 received in two slots 236 of the second track 2, respectively. Thus, when the second track 2 is engaged between the upper and lower longitudinal lips 13 of the first track 1, the second track 2 slides freely in the first track 1 under the aid from the slide-aiding members 14. At this time, the retaining member 11 and the pressing block 22 are disengaged from each other.

Figure 4:
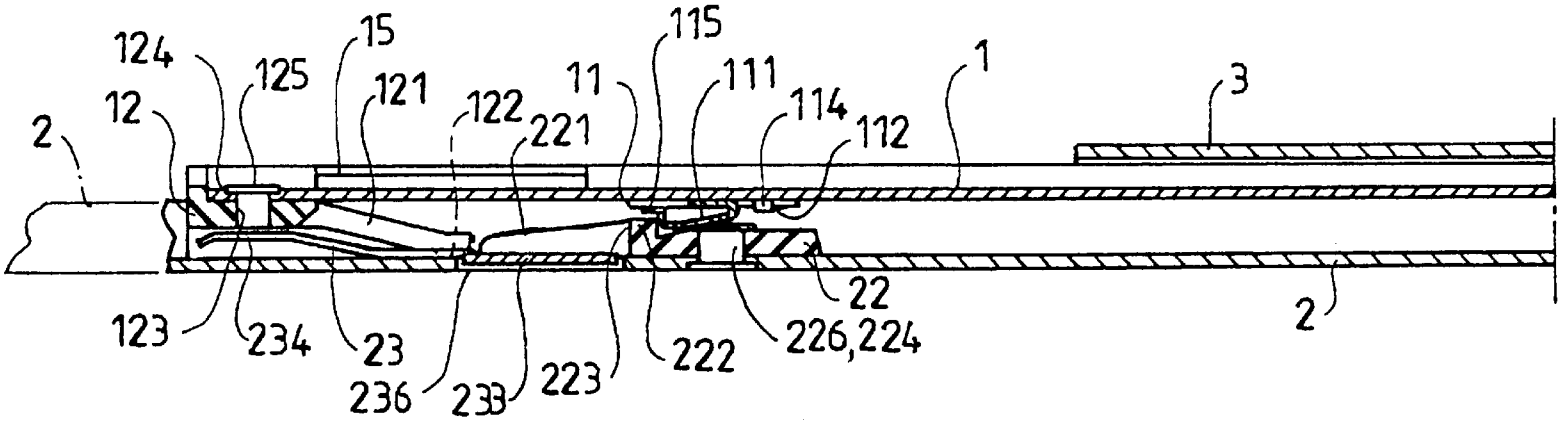
FIG. 4 is a view similar to FIG. 3, wherein the retaining member of the first track is engaged with the pressing block of the second track.
Figure 5:
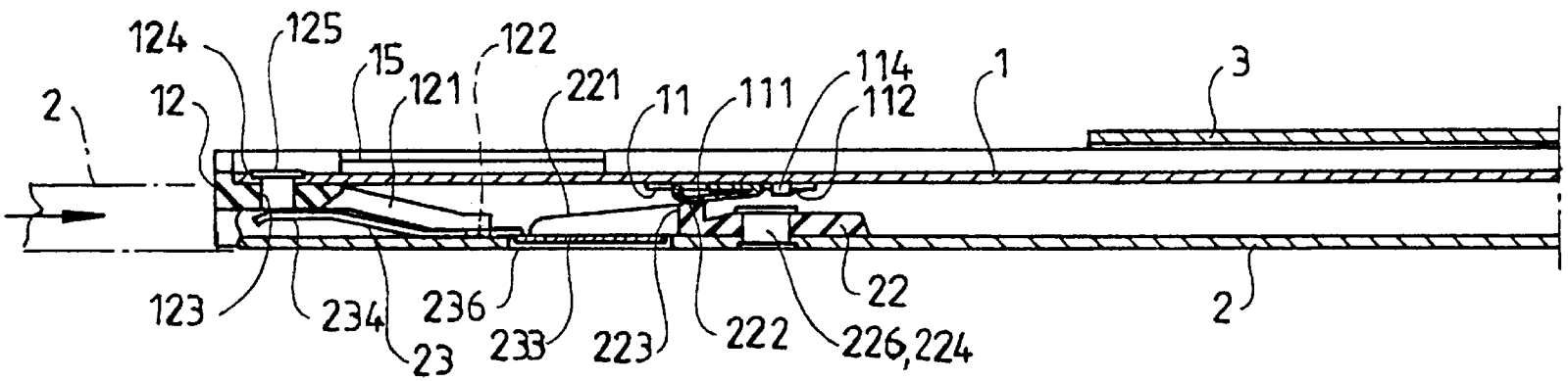
FIG. 5 is a view similar to FIG. 4, wherein the pressing block of the second track presses against the retaining member of the first track.

FIGS. 4 and 5 illustrate operation of the retaining member 11 of the first track 1 and the pressing block 2 of the second track 2. When the user pulls the second track 2 outward, the two protrusions 222 of the pressing block 22 press against the legs 111 of the retaining member 11, then move across the legs 111, and are finally stopped by the legs 111. Since the retaining member 11 is made from a resilient metal sheet, it can restore to its original shape after it is pressed against by the protrusions 222. When the second track 2 is stopped and retained in place, the legs 111 of the retaining member 11 are engaged with inner sides of the protrusions 222 of the pressing block 22. Thus, the retaining member 11 prevents inadvertent inward movement of the second track 2, best shown in FIG. 4. When the user pushes the second track 2 inward with an appropriate force, the protrusions 222 of the second track 2 deform the legs 111. Thus, the protrusions 222 may move across the legs 111, thereby allowing movement of the second track 2 into the first track 1. Since the retaining member 11 is resilient, it restores to its original shape after it is pressed against by the protrusions 222. Thus, the retaining member 11 of the first track 1 and the pressing block 22 of the second track 2 together provide a retaining structure for the track device to thereby prevent inadvertent inward movement of the second track 2 in the first track 1 when the second track 2 is inadvertently impinged by the user.

Figure 6:
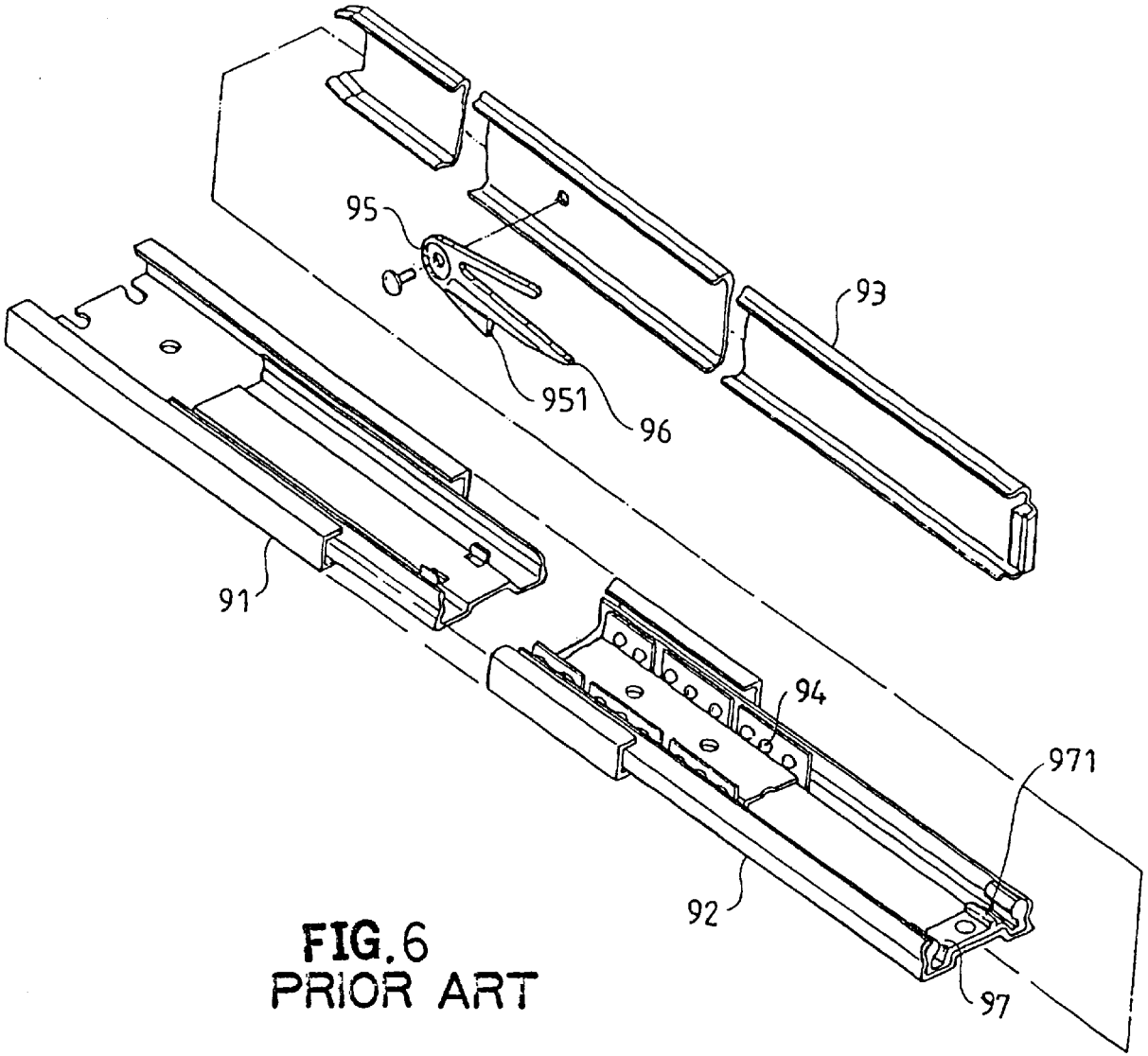
FIG. 6 PRIOR ART
FIG. 6 is an exploded perspective view of a conventional track device for a drawer.

Comparing FIG. 1 with FIG. 6, the track device in accordance with the present invention provides the same function of preventing outward disengagement of the second track 2 (inner track 93 in FIG. 6) from the first track 1 (middle track 92 in FIG. 6) by means of engagement between the hooks 122 of the legs 121 of the catching member 12 and the shoulders 223 of the pressing block 22. In addition, the retaining structure in accordance with the present invention provides an additional function of preventing inward movement of the second track 2 (inner track 93 in FIG. 6) after it is pulled outward to a predetermined position. This is achieved by resilient engagement between the legs 111 of the retaining member 11 and the inner sides of the protrusions 222 of the pressing block 22, which reliably retains the second track 2 in place after it is pulled outward to the predetermined position.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A track device comprising:

a first track comprising an upper longitudinal lip and a lower longitudinal lip, a retaining member, the retaining member comprising plural legs, a mounting member and a positioning hole, an engaging slot adapted for securely receiving the mounting member and a positioning block adapted to be securely engaged with the positioning hole;

a second track slidably received in the first tract and guided between the upper longitudinal lip and the lower longitudinal lip of the first track, the second track comprising a pressing block, the pressing block comprising plural protrusions for pressing against the plural legs of the retaining member; and wherein the second track is mounted in the first track and pulled outward to a predetermined position, the legs of the retaining member press against inner sides of the protrusions of the pressing block to thereby prevent inadvertent inward movement of the second track in the first track, and when the second track in the predetermined position is pushed inward by an appropriate force, the protrusions of the pressing block press against and thus deform the legs of the retaining member to thereby allow the protrusions of the pressing block to move across the retaining member, thereby allowing inward movement of the second track in the first track.

2. The track device as claimed in claim 1, wherein the retaining member is made of a resilient material.

3. The track device as claimed in claim 2, wherein the retaining member is made from a resilient metal sheet.

4. The track device as claimed in claim 1, wherein the retaining member is made from a resilient metal sheet.

5. The track device as claimed in claim 1, wherein the retaining member comprises two said legs that are deformable.

6. The track device as claimed in claim 1, wherein the pressing block comprises two protrusions.

7. The track device as claimed in claim 1, wherein the retaining member is securely mounted to the first track by a fixing structure.

8. The track device as claimed in claim 1, wherein the pressing block is securely mounted to the second track by a fixing structure.

9. The track device as claimed in claim 8, wherein the pressing block comprises a positioning hole, the second track comprising a hole aligned with the positioning hole, the pressing block further comprising a fastener extending through the positioning hole of the pressing block and the hole of the second track, thereby securing the pressing block to the second track.

10. The track device as claimed in claim 1, wherein the pressing block comprises a positioning hole, the second track comprising a hole aligned with the positioning hole, the pressing block further comprising a fastener extending through the positioning hole of the pressing block and the hole of the second track, thereby securing the pressing block to the second track.

11. The track device as claimed in claim 1, further comprising a third track including an upper longitudinal lip and a lower longitudinal lip for slidably receiving the first track.

* * * * *